US007014373B2

(12) United States Patent
Piccinino, Jr. et al.

(10) Patent No.: US 7,014,373 B2
(45) Date of Patent: Mar. 21, 2006

(54) PHOTOGRAPHIC PROCESSING ARRANGEMENT AND A PROCESSING SOLUTION SUPPLY CARTRIDGE FOR THE PROCESSING ARRANGEMENT

(75) Inventors: Ralph L. Piccinino, Jr., Rush, NY (US); Charles M. Darmon, Spencerport, NY (US); Daniel R. English, Pittsford, NY (US); Paul A. Schwartz, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 19 days.

(21) Appl. No.: 10/722,249

(22) Filed: Nov. 25, 2003

(65) Prior Publication Data

US 2005/0112511 A1 May 26, 2005

(51) Int. Cl.
*G03D 3/06* (2006.01)

(52) U.S. Cl. ..... 396/564; 396/626

(58) Field of Classification Search ..... None
See application file for complete search history.

(56) References Cited

U.S. PATENT DOCUMENTS

| | | | | | |
|---|---|---|---|---|---|
| D86,749 | S | | 4/1932 | Sciuto | D9/741 |
| 3,851,029 | A | | 11/1974 | Cornett et al. | 264/525 |
| 4,533,225 | A | * | 8/1985 | Shiga | 396/622 |
| 4,547,900 | A | | 10/1985 | Larkin et al. | 206/628 |
| 5,148,208 | A | * | 9/1992 | Klosterboer et al. | 396/626 |
| D333,980 | S | | 3/1993 | Schmitt | D9/524 |
| D341,085 | S | | 11/1993 | Charbonneau et al. | D9/524 |
| D341,314 | S | | 11/1993 | Charbonneau et al. | D9/520 |
| 6,017,687 | A | | 1/2000 | Darmon et al. | 430/466 |
| 6,037,111 | A | | 3/2000 | Haye et al. | 430/441 |
| 6,077,651 | A | | 6/2000 | Darmon et al. | 430/466 |
| 6,136,518 | A | | 10/2000 | Buongiorne et al. | 430/486 |
| 6,138,853 | A | | 10/2000 | Frechette | 220/212.5 |
| 6,159,670 | A | | 12/2000 | Buongiorne et al. | 430/491 |
| 6,193,424 | B1 | * | 2/2001 | Ogiso | 396/578 |
| 6,228,567 | B1 | | 5/2001 | Darmon et al. | 430/466 |
| D451,029 | S | | 11/2001 | Hoffmann | D9/524 |
| D456,075 | S | | 4/2002 | Clements et al. | D24/121 |
| 6,403,290 | B1 | | 6/2002 | Haye et al. | 430/357 |
| 6,416,940 | B1 | | 7/2002 | Haye et al. | 430/466 |
| 6,468,722 | B1 | | 10/2002 | Call et al. | 430/461 |
| 6,505,655 | B1 | | 1/2003 | Piccinino, Jr. et al. | 141/2 |
| 6,520,693 | B1 | | 2/2003 | Lobo et al. | 396/564 |

FOREIGN PATENT DOCUMENTS

DE 118144 * 11/1988

OTHER PUBLICATIONS

Verlinden et al.; Method of Supplying Processing Liquid To A Photographic Processing Machine And Removing Waste Liquid Therefrom; Apr. 1998; Research Disclosure; pp 425-428.*

* cited by examiner

*Primary Examiner*—D. Rutledge
(74) *Attorney, Agent, or Firm*—David A. Norais

(57) ABSTRACT

The present invention relates to a processing solution supply cartridge which utilizes a single container for a single-part developer concentrate. The single container has at least two valves or necks and is adapted to be utilized on a existing processor or processing machine. The single developer container design of the present invention assures a complete emptying of the container by permitting the simultaneous replenishment of single-part developer through each of the valves into the processing machine. With the combination of the single developer container and the single-part developer the process of metering distinct developers through distinct containers is not required. By facilitating the complete emptying of the developer container, the likelihood of developer solution remaining in the container is minimized.

10 Claims, 9 Drawing Sheets

PHOTOGRAPHIC PROCESSING ARRANGEMENT AND A PROCESSING SOLUTION SUPPLY CARTRIDGE FOR THE PROCESSING ARRANGEMENT

FIELD OF THE INVENTION

The present invention relates to a photographic processing arrangement for processing photographic material that includes a photographic processor and a photofinishing supply cartridge. The present invention further relates to a photofinishing solution supply cartridge which is adapted to be fluidly associated with a processor, and is further adapted to achieve a complete emptying of solutions from containers of the cartridge to facilitate handling of the empty cartridge.

BACKGROUND OF THE INVENTION

Conventional film and paper processing machines have difficulty in completely emptying the chemical cartridges associated with the machines. This is due to the highly coupled nature of the system since the processing machines are associated with a solution supply cartridge or arrangement that includes four independent containers that need to empty simultaneously. If a container of the cartridge contains significant retained chemistry following use, there is a possibility that the cartridge must be handled as hazardous waste.

FIG. 1 is a schematic illustration of a conventional solution cartridge 200. As shown in FIG. 1, solution cartridge 200 includes an outer container 2 that is adapted to hold four inner containers 4*a*, 4*b*, 4*c*, 4*d*. Each of containers 4*a*–4*d* is dedicated to a specific type of solution or chemical concentrate, for example, container 4*a* holds a first part of a color developer; container 4*b* holds a second part of a color developer; container 4*c* holds a third part of a color developer; and container 4*d* holds a stabilizer. Each of containers 4*a*–4*d* respectively include valves or necks 6*a*, 6*b*, 6*c*, 6*d* which extend from each of containers 4*a*–4*d* and pass through appropriate openings in outer container 2. In the arrangement of FIG. 1, it is preferable that the different parts of the color developer be held in separate containers (4*a*–4*c*) prior to being supplied to a processor or processing machine, since any mixture of the different parts of the developers prior to usage will degrade and adversely affect the properties of the developers.

In a conventional arrangement, cartridge 200 is adapted to be fluidly associated with a processor 10 which includes entry points or valves 12*a*, 12*b*, 12*c*, 12*d* that are adapted to be associated with each of valves or necks 6*a*, 6*b*, 6*c*, and 6*d*. Therefore the current cartridge package as noted above has four necks or valves 6*a*–6*d* that associate with four corresponding valves or entry points 12*a*–12*d* of processing machine 10. The full/empty state of cartridge 200 is sensed by the presence or absence of float, indicated by reference numerals 14*a*, 14*b*, 14*c* and 14*d* in FIG. 1, which are associated with each of valves 6*a*–6*d*. In one embodiment, an infrared beam can pass through valves 6*a*–6*d* of the cartridge 200 to detect the presence or absence of a float 14*a*–14*d* to determine the full/empty state of the individual container 4*a*, 4*b*, 4*c* and 4*d*. As further described above, four chemical concentrates are contained in four separate containers 4*a*–4*d* housed in a common outer container 2.

A drawback with the arrangement noted above is that during use of cartridge 200, developer or chemical concentrate exiting from each container 4*a*–4*d* through respective valves 6*a*, 6*b* and 6*c* is constantly metered and observed so as to assure that each of containers 4*a*–4*c* empty together. If they do not empty together as noted above, then at least one of the containers will include residual chemistry following use, which leads to the characterization of the handling of the container as hazardous waste.

SUMMARY OF THE INVENTION

The present invention provides for an improved photofinishing solution supply cartridge for a photographic processing arrangement, wherein its emptying is controlled by only one chemical cartridge, to thereby guarantee that the cartridge can be disposed of as non-hazardous waste. Additionally, the chemical solution supply cartridge of the present invention is adapted to process more prints since the emptying of the containers that includes the developer can be more accurately controlled.

In a feature of the present invention, a single container is used due to the utilization of a single-part developer concentrate in the container. U.S. Pat. Nos. 6,017,687; 6,037,111; 6,077,651; 6,136,518; 6,159,670; 6,328,567; 6,403,290; and 6,416,940 the contents of which are herein incorporated by reference, teach a single-part color developing concentrate and a method of making the single-part color developing concentrate, which is used in the photofinishing solution supply cartridge and arrangement of the present invention.

In the present invention, the current three-part developer concentrate as illustrated in FIG. 1 is replaced by a single-part developer concentrate as described in the above patents. Further, the three developer concentrate containers are replaced by a single container. This single container can be simultaneously emptied through at least first and second valves on the container. By utilizing a single container with a single-part developer as discussed above, it is possible to simultaneously supply processing solution through the two valves of necks of the single container. Because of the use of a single container, the complete emptying of the container is assured so as to minimize any hazardous material remaining in the container.

The present invention accordingly provides for a photofinishing solution supply cartridge that comprises an outer container; one developer solution container provided within the outer container, with the developer solution container holding a single-part developer therein and comprising at least two developer container valves for fluid communication with a photographic processor; and a stabilizer solution container provided in the outer container and comprising a stabilizer solution container valve for fluid communication with the photographic processor. The outer container has at least three openings to permit the two developer container valves and the stabilizer solution container valve to pass therethrough.

The present invention further relates to a method of processing photographic material which comprises fluidly associating a solution supply cartridge with a photographic processor, with the solution supply cartridge comprising one developer container with at least two valves, and the two valves providing a fluid communication between the developer container and the photographic processor. The developer container holds a single-part developer therein. The method further comprises supplying a single-part developer to the photographic processor during a processing cycle to process photographic material in the photographic processor, with the single-part developer being simultaneously supplied through the two valves.

The present invention further relates to a photofinishing solution supply cartridge which comprises an outer container; and a single developer solution container provided within the outer container, with the developer solution container holding a single-part developer therein and comprising two developer container valves for fluid communication with the photographic processor.

The present invention further relates to a photofinishing arrangement that comprises a photographic processor adapted to process photographic material therein; and a photofinishing solution supply cartridge comprising an outer container and a single developer solution container provided within the outer container. The developer solution container holds a single-part developer therein and comprises two developer container valves for fluid communication with the photographic processor.

DETAILED DESCRIPTION OF THE INVENTION

Figure 2:
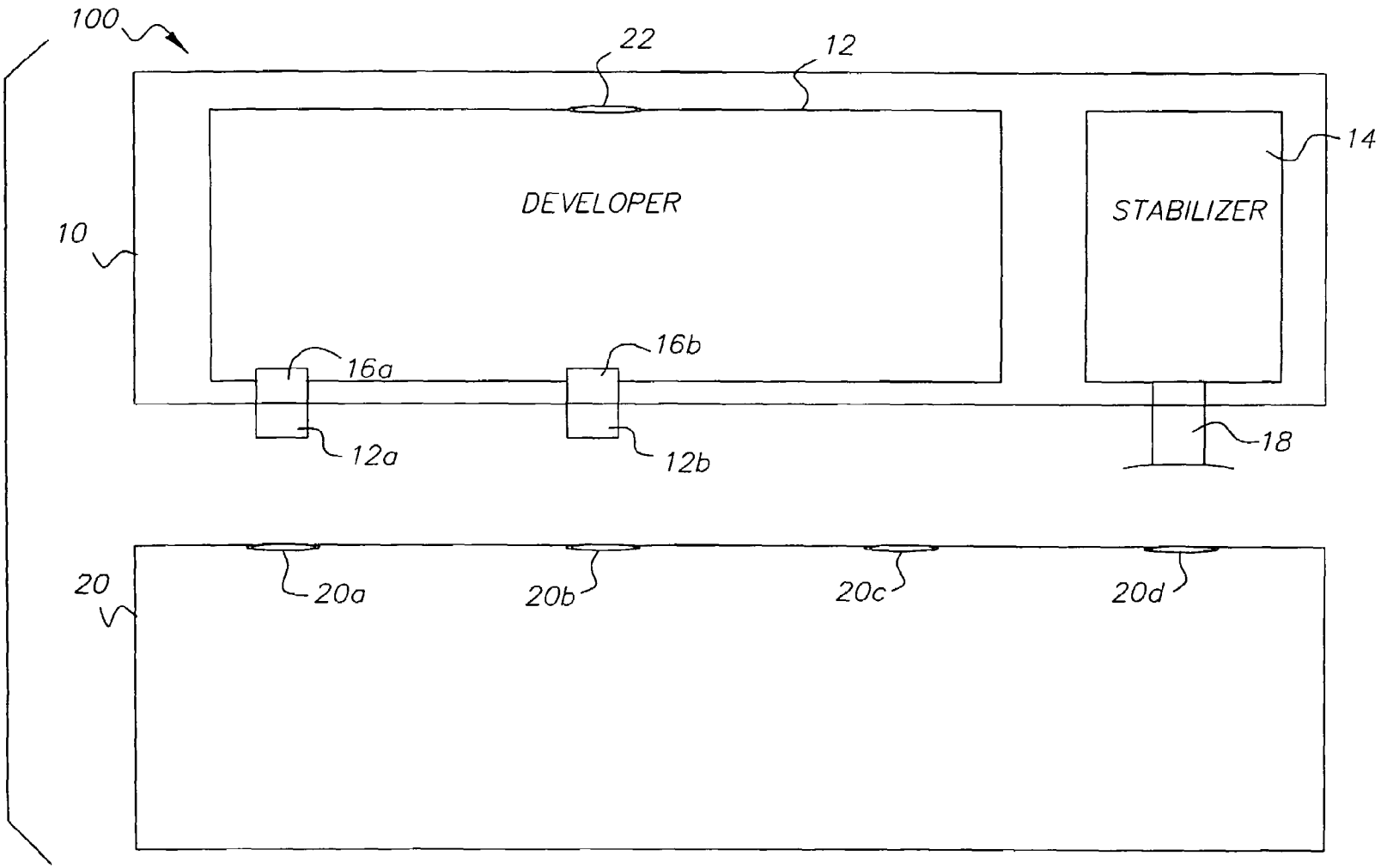
FIG. 2 is a schematic view of a solution supply cartridge in accordance with the present invention, wherein the cartridge is adapted to be fluidly associated with a photographic processor.

Referring now to the drawings, wherein like reference numerals represent corresponding or identical parts throughout the several views, FIG. 2 illustrates a cartridge or assembly in accordance with a first feature of the present invention. As illustrated in FIG. 2, a processing solution supply cartridge 100 includes an outer container 10 which has positioned therein a single inner container 12 for holding a single-part developer concentrate as described in, for example, U.S. Pat. No. 6,017,687 and the other patents cited to show single-part developers. Also provided within outer container 10 is an inner container 14 used for holding stabilizer solution therein. Container 12 includes valves 12*a* and 12*b* which are adapted to provide fluid communication with a photographic processor 20. Each valve 12*a*, 12*b* respectively includes a float 16*a*, 16*b* therein. Stabilizer container 14 includes a valve 18 for fluid communication with processor 20. Floats 16*a*, 16*b* within valves 12*a*, 12*b* can be adapted to provide a signal to a controller or to an operator to signal the empty/full state of container 12. As an example, an infrared beam can be directed to the valves to detect the presence or absence of the floats. Valve 18 for stabilizer container 14 does not include a float therein. This ensures that single developer container 12 must empty to signal that cartridge 100 requires replacement. If stabilizer container 14 empties prematurely, water can be the sole source of replenishment for the stabilizer tank until the cartridge is replaced.

Cartridge 100 is adapted to be fluidly associated as noted above, with photographic processor 20 for processing photographic material. That is, photographic processor 20 is of the type which processes photographic material by passing or conveying the photographic material through distinct photo-chemical solutions for processing the photographic materials. Processor 20 can be an existing processor which includes corresponding valves or openings 20*a*, 20*b*, 20*c* and 20*d* which are aligned with the valves of a traditional solution cartridge as illustrated in FIG. 1.

Figure 1:
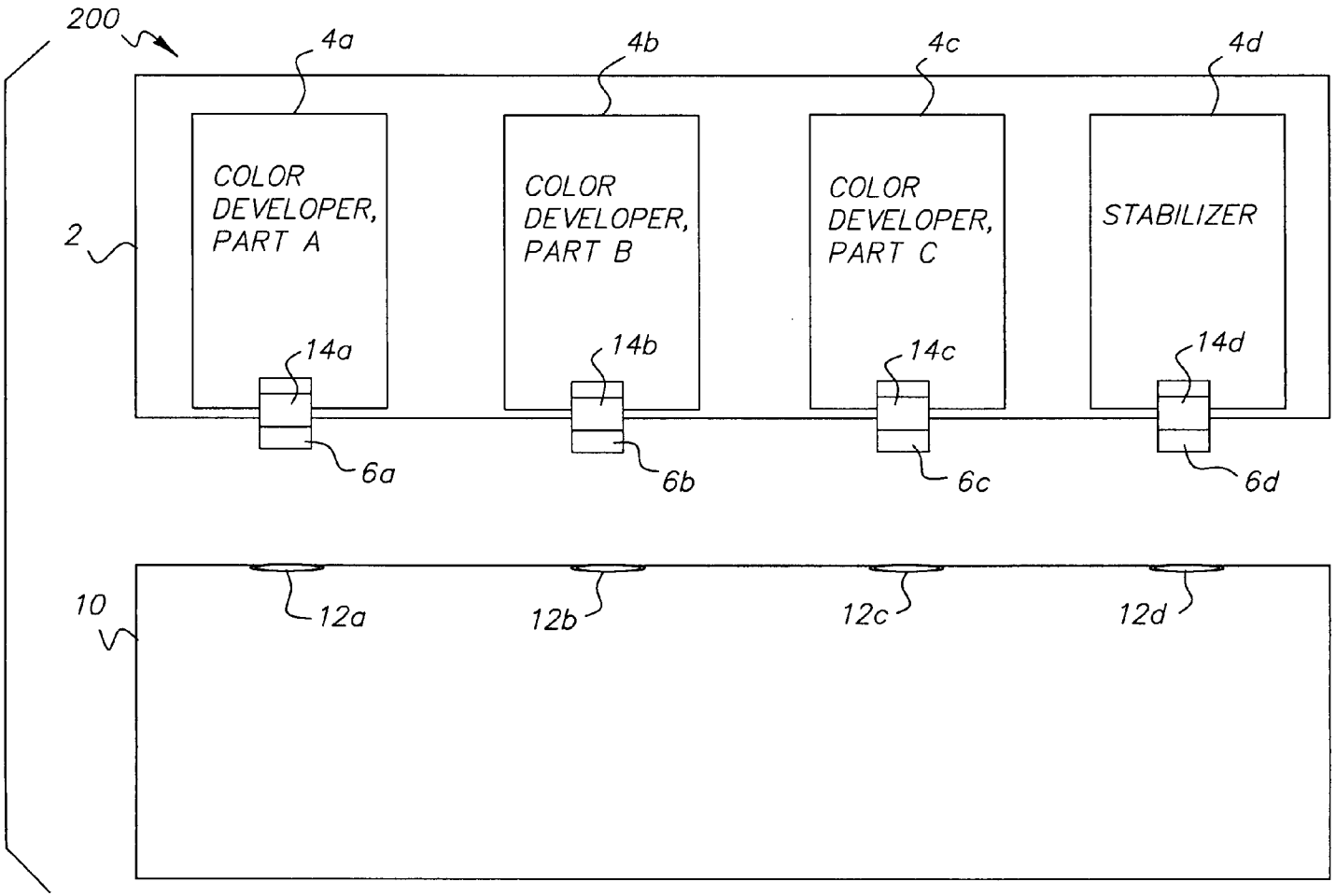
FIG. 1 (PRIOR ART)
FIG. 1 is a schematic illustration of a conventional solution supply cartridge associated with a known photographic processor.

With the conventional arrangement of FIG. 1, where traditional developers are used, the different parts of the developers need to be stored in separate containers due to the fact that the mixing of the different developer parts during storage or while in the chemical supply cartridge adversely affects the properties of the developer. With a single-part developer as shown and described in the above-noted cited patents, it is not necessary to separate the developer parts and therefore, a solution supply cartridge 100 as shown in FIG. 2 which includes a single developer container can be utilized. The advantage of using the single developer container as noted above is that during a processing cycle, the single-part developer can be replenished into processor 20 by simultaneously supplying the single-part developer through valves 12*a* and 12*b* into processor 20. This assures that all of the developer within single container 12 empties into processor 20. Also, with the developer being simultaneously supplied through two valves of a single container, it is assured that no developer remains in the container, and it is not necessary to meter the amount of color developer coming from distinct developer containers. Therefore, no hazardous developer will remain in the container after the appropriate amount of processing cycles have been achieved.

A further advantage of a solution supply cartridge with a single developer container as noted above is that the cartridge can be fluidly associated with the valves of a traditional processor which has three to four valves, by fluidly associating the two valves 12*a* and 12*b* with the two existing valves 20*a* and 20*b* on processor 20, while closing valve 20*c*. Therefore, processor 20 believes that is operating in a known manner and therefore processes photographic material accordingly. Thus, cartridge 100 can be utilized on existing processing machines.

Further, by having floats 16*a* and 16*b* in valves 12*a* and 12*b*, a signal can be sent when all the developer solution is emptied from container 12 to automatically alert an operator that at the supply cartridge needs to be replaced.

In a further feature of the present invention, developer container 12 can be reusable be providing for an opening 22 in developer container 12. Therefore, after all of the single-part developer has been emptied from container 12, a user can simply refill developer container 12 with new single-part developer concentrate through opening 22, without having to remove cartridge 100 from processor 20.

Figure 3:
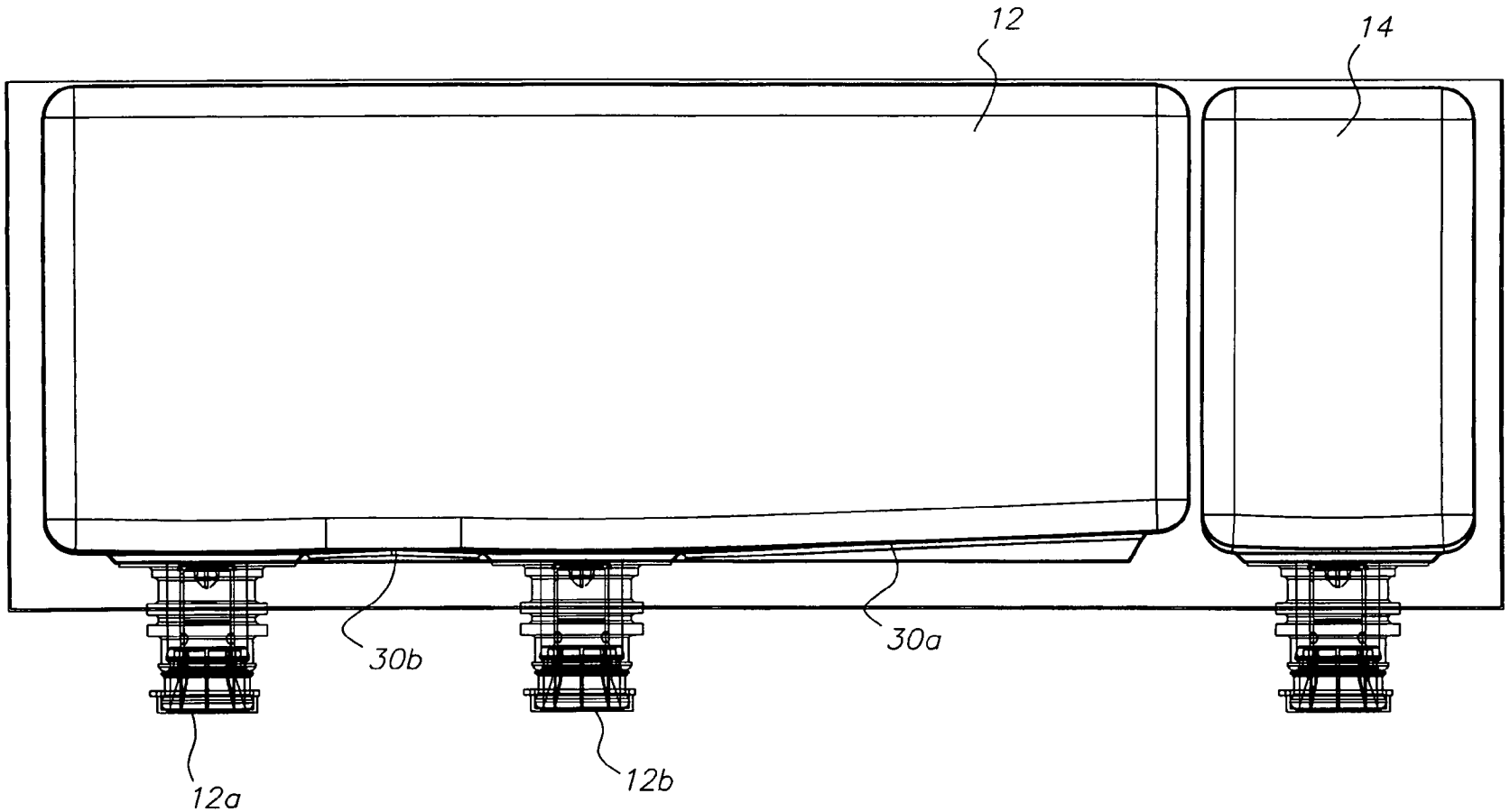
FIG. 3 is a view of a solution supply cartridge in accordance with the present invention, wherein a single developer container of the cartridge includes an inclined surface to promote complete emptying of the container.

With reference to FIG. 3, an arrangement of the present invention to further assure complete drainage of developer within container 12 is shown. More specifically, in FIG. 3, container 12 is shown as having an inclined surface 30*a* which leads in a downward direction to a surface 30*b* that is in the vicinity of valves 12*a*, 12*b*. This assures that all the developer will flow toward the valves 12*a* and 12*b* and facilitates the complete emptying of container 12.

Figure 4:
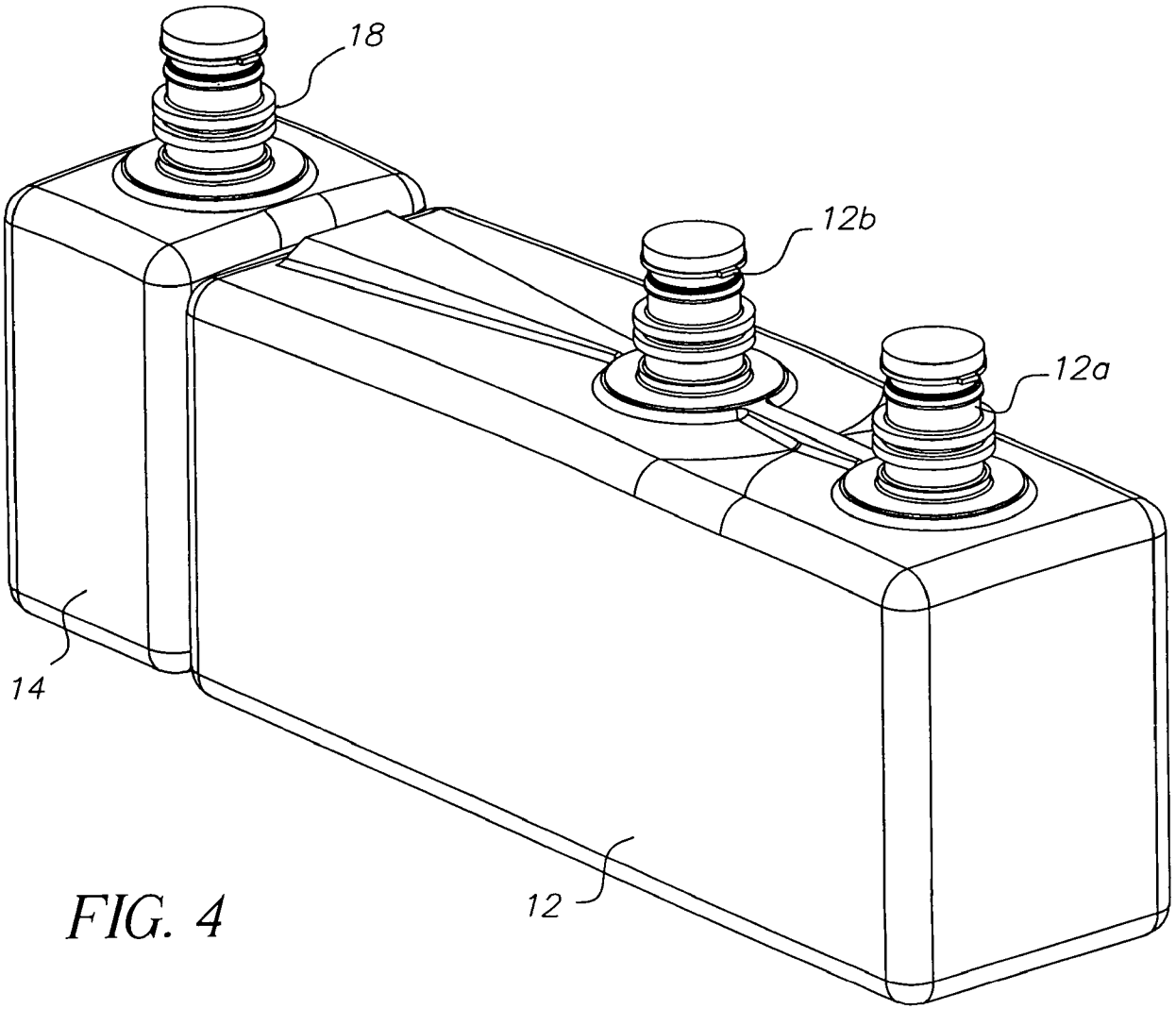
FIG. 4 is a view of the developer container and the stabilizer container of the cartridge of the present invention.

FIG. 4 is a view of single developer container 12 and stabilizer container 14 of the present invention, and shows the design of the containers in a side by side relationship so as to be positionable in outer container 10 in a manner which takes up a minimum amount of space.

Figure 5:
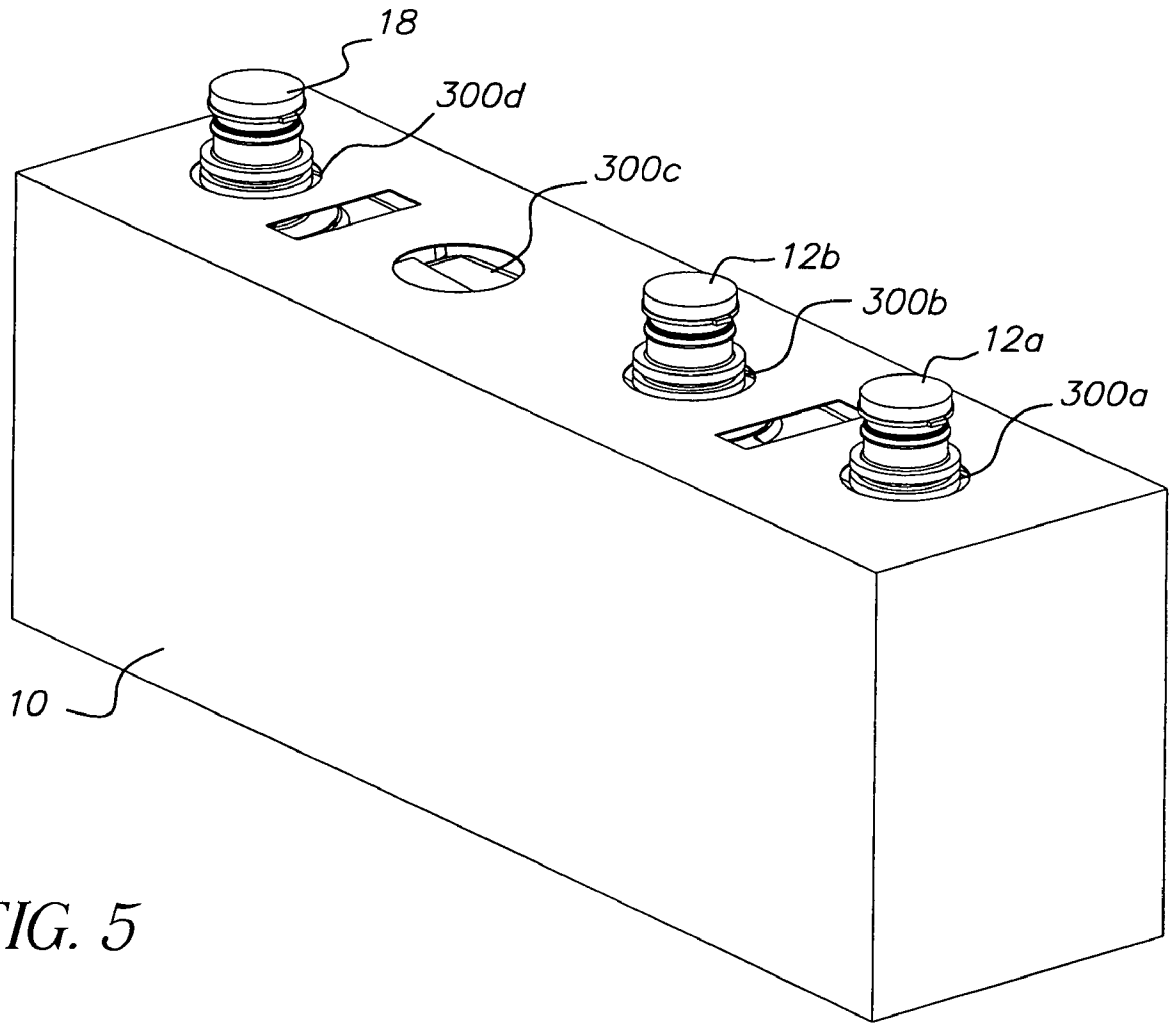
FIG. 5 is a perspective view of the solution cartridge with the outer container in accordance with the present invention.

FIG. 5 shows container 12 and container 14 within an outer container 10. As shown, outer container 10 has openings 300*a*–300*d*, wherein openings 300*a*, 300*b* and 300*d* are respectively aligned with valves 12*a*, 12*b* and 18 and thus, permit the passage of the valves therethrough. FIG. 5 illustrates that cartridge 100 of the present invention can be utilized with container 10 designed for traditional cartridges which store developer in separate containers.

Figure 6:
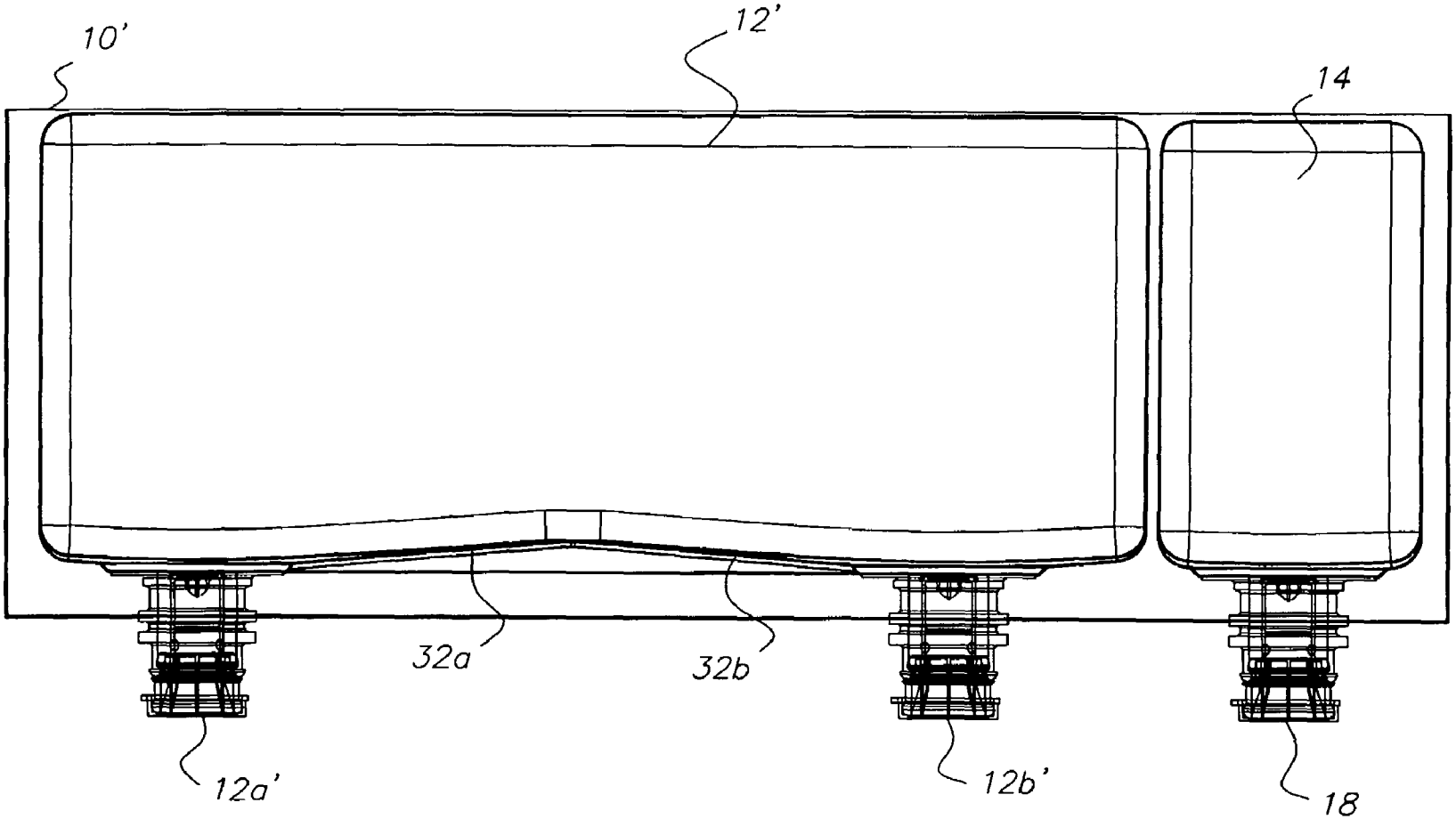
FIG. 6 is a still further view of the solution supply cartridge of the present invention, wherein the position of the valves have been varied.

FIG. 6 illustrates a further embodiment of the cartridge in accordance with the present invention. In FIG. 6, valves 12*a*' and 12*b*' are on the outer edges of container 12'. With the arrangement of FIG. 6, in order to assure the complete draining of developer from developer container 12', surfaces 32*a* and 32*b* can be inclined in opposite directions towards respective valves 12*a*' and 12*b*'. The remaining parts of the cartridge shown in FIG. 6 remains the same in that the cartridge includes an outer container 10' and stabilizer container 14. Further, the embodiment of FIG. 6 can be utilized in an existing processing machine in that valves 12*a*' and 12*b*' can be aligned with valves 20*a* and 20*c* of existing processor 20 of FIG. 2, while opening 20*b* could be closed.

Figure 7:
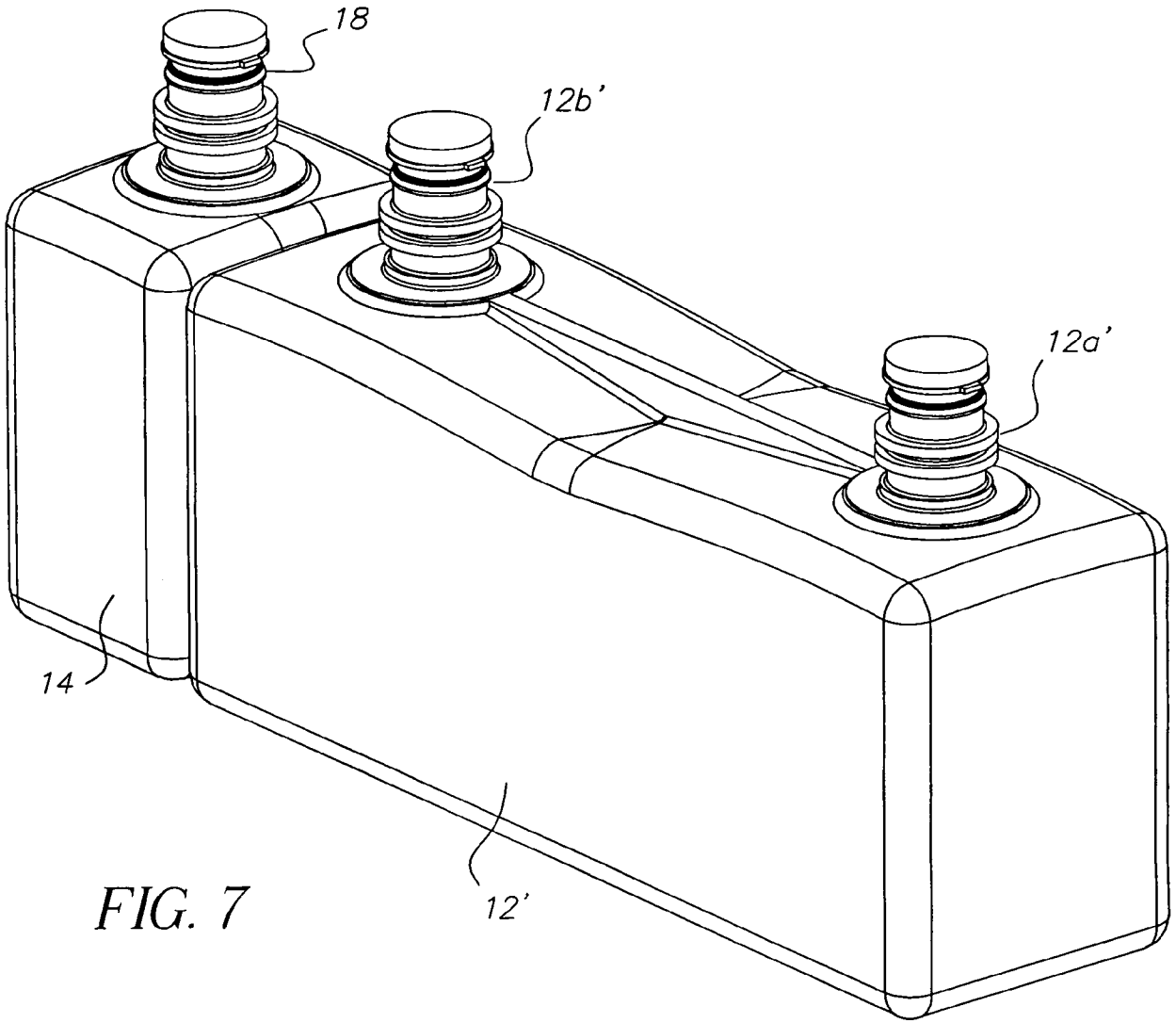
FIG. 7 is a view of the developer container and the stabilizer container of the solution supply cartridge of FIG. 6.

FIG. 7 is a perspective view of containers 12*a*', 12*b*' and 14 of FIG. 6, wherein the containers are shown in a side by side manner, for positioning within outer container 10'. This configuration assures that the containers utilize a minimum amount of space when positioned within the outer container.

Figure 8:
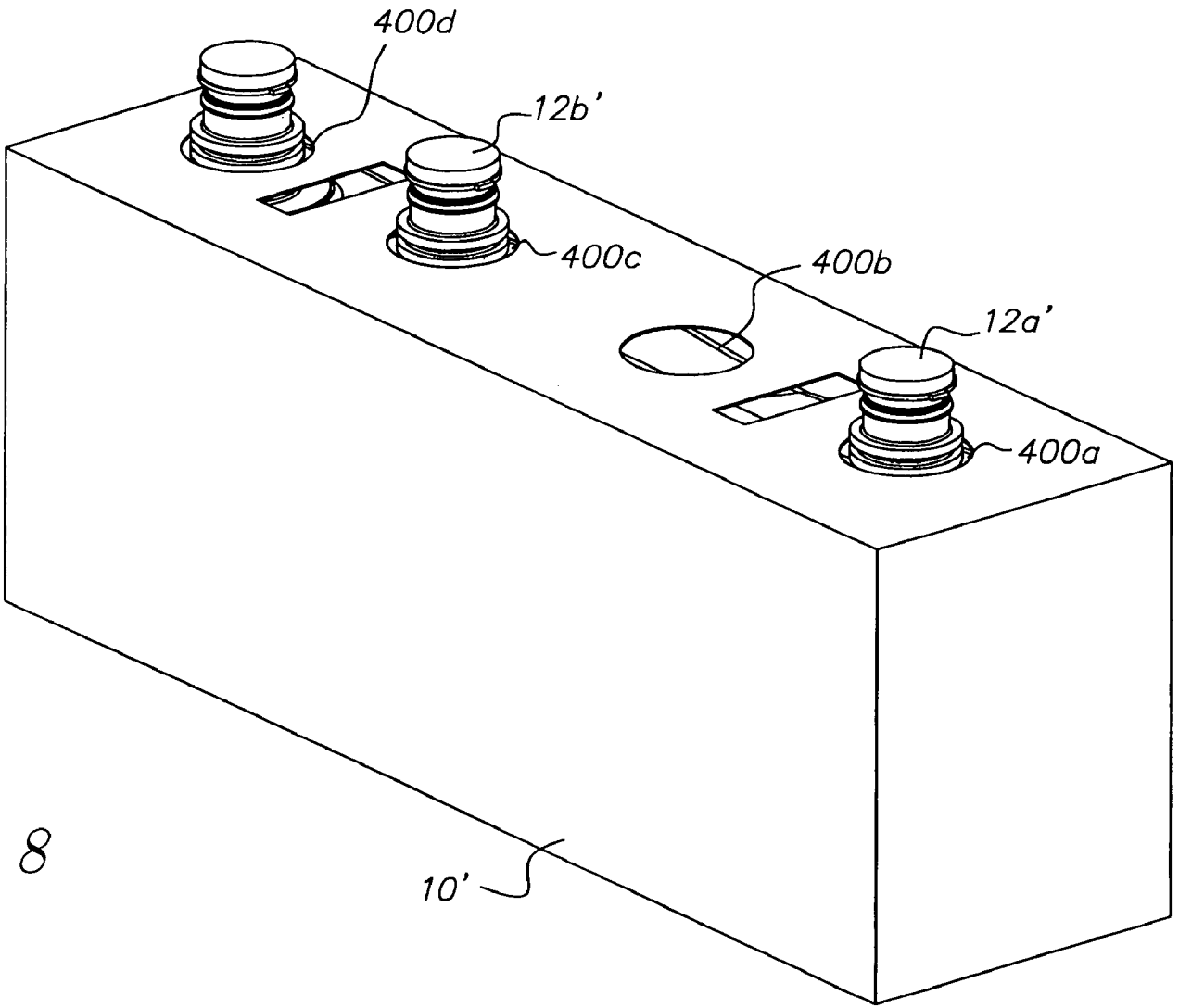
FIG. 8 is a further view of the solution supply cartridge FIG. 6.

FIG. 8 shows outer container 10' of the embodiment of FIG. 6, wherein outer container 10' includes openings 400*a*–400*d*, such that openings 400*a*, 400*c* and 400*d* are aligned respectively with valves 12*a*', 12*b*' and 18. Again, this illustrates that a standard container could be utilized with the cartridge of the present invention.

Figure 9:
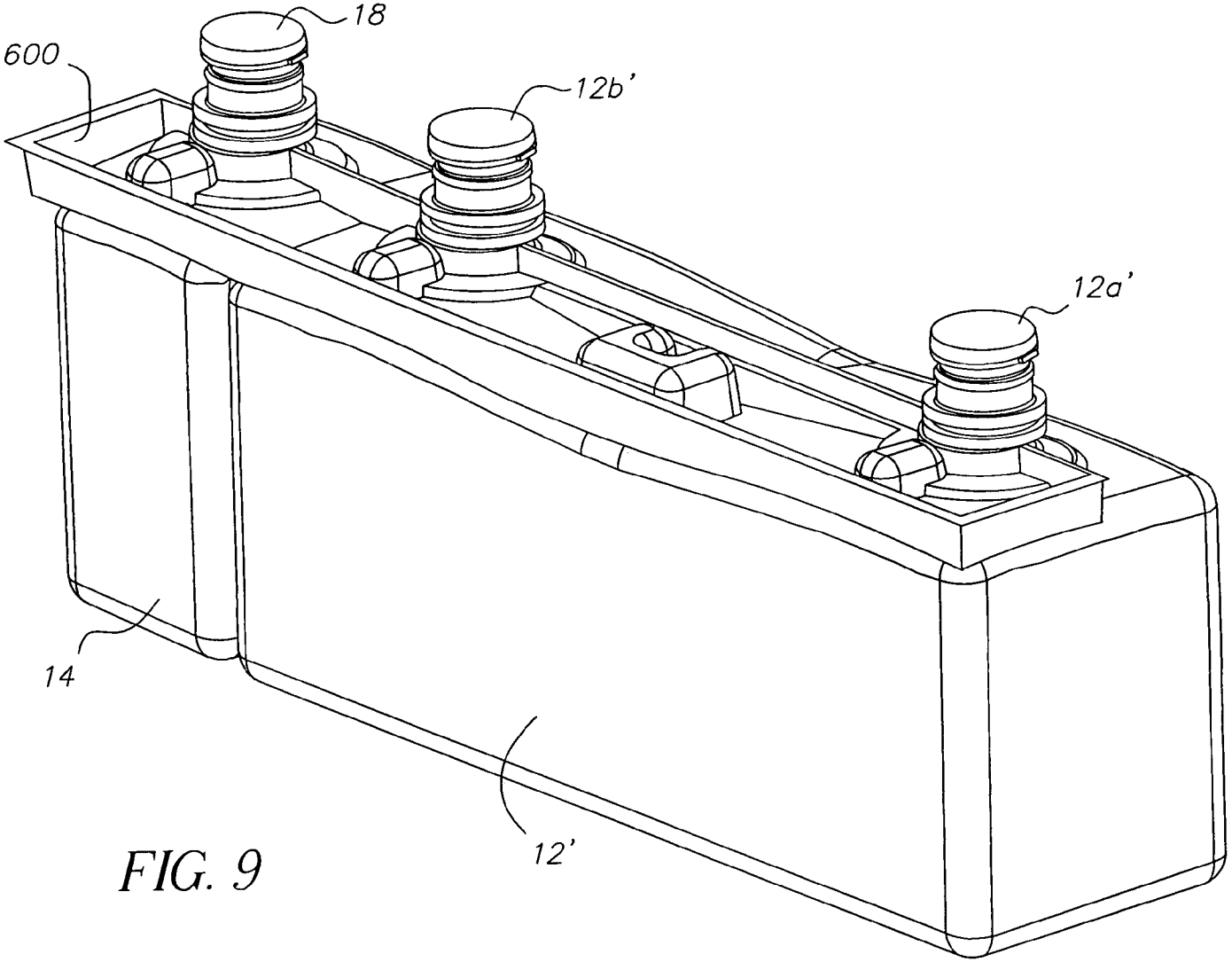
FIG. 9 is a view of a further embodiment of the solution supply cartridge of the present invention.

FIG. 9 illustrates an alternative embodiment wherein a top frame 600 instead of an outer container is used. Top frame 600 can be located on valves 12*a*', 12*b*' and 18 to hold the valves as well as-the containers 12, 14 in position when the containers are fluidly associated with a processing machine. The arrangement of FIG. 9 shows one part or half (left side) of frame 600. It is recognized that frame 600 includes an opposite part or half (right side) which mirrors the first part and is provided on top of the containers in a similar manner as the first part.

Therefore, the present invention provides for a cartridge where the complete emptying of a single-part developer solution into a processor is controlled by only one developer container, thereby guaranteeing that the cartridge can be disposed of as non-hazardous waste. The cartridge of the present invention has a single container which holds a single-part developer concentrate. The single-part-developer concentrate is simultaneously replenished into a processing machine through at least two valves to assure the complete emptying of the developer container. The choice of valves utilized in the cartridge of the present invention can be based on necessary replenishment rates required by existing processors in the field, or by rates required by new processors specifically designed for the cartridge of the present invention. The stabilizer solution can be delivered from its location analogous to the conventional package as described above. The stabilizer valve or neck of the present invention does not have a float in it to ensure that the developer container empties to signal that the package requires replacing. If the stabilizer position empties prematurely, water can be the sole source of replenishment until the package is replaced.

The complete emptying of the developer container of the present invention results in increase customer satisfaction and easier disposal of spent cartridges. Further, the increased capacity of the containers of the present invention results in lower customer inventory space required and fewer cartridge changes per unit time.

The invention has been described in detail with particular reference to certain preferred embodiments thereof, but it will be understood that variations and modifications can be effected within the spirit and scope of the invention.

What is claimed is:

1. A photofinishing solution supply cartridge comprising:

an outer container;

one developer solution container provided within the outer container, said developer solution container holding a single-part developer therein and comprising at least two developer container valves for fluid communication with a photographic processor; and a stabilizer solution container provided in said outer container and comprising a stabilizer solution container valve for fluid communication with the photographic processor, said outer container having at least three openings to permit said two developer container valves and said stabilizer solution container valve to pass there-through;

wherein a surface of said developer solution container which includes said two developer container valves has a downward incline in a direction toward each of said two developer container valves to permit a complete draining of the single-part developer from said developer solution container.

2. A photofinishing supply cartridge according to claim 1, wherein each of said two developer container valves comprises a float therein and said stabilizer solution container valve does not contain a float.

3. A photofinishing supply cartridge according to claim 1, wherein during a processing cycle, said developer solution container is adapted to supply said single-part developer to the photographic processor simultaneously through said two developer container valves.

4. A photofinishing supply cartridge according to claim 1, wherein said developer solution container is reusable and comprises a supply opening, such that when said developer solution container is emptied, said supply opening permits a refilling of said developer container with single-part developer.

5. A method of processing photographic material, the method comprising:

fluidly associating a solution supply cartridge with a photographic processor, said solution supply cartridge comprising one developer container with at least two valves, said two valves providing a fluid communication between the developer container and the photographic processor, said developer container holding a single-part developer therein;

supplying said single part developer to said photographic processing during a processing cycle to process photographic material in said photographic processor, said single part developer being simultaneously supplied through said two valves; and refilling said developer container through a supply opening on said developer container when the developer container is empty, said refilling step being performed while said solution supply cartridge is associated with said photographic processor.

6. A method according to claim 5, further comprising:

supplying a stabilizing solution to said photographic processor at an end of said processing cycle.

7. A photofinishing solution supply cartridge comprising:

an outer container; and a single developer solution container provided within the outer container, said developer solution container holding a single-part developer therein and comprising two developer container valves for fluid communication with a photographic processor;

wherein said single developer solution container is reusable and comprises a supply opening to permit a refilling of said single developer solution container with single-part developer, said supply opening being located on a suface of said single developer solution container that does not include said two developer container valves.

8. A photofinishing arrangement comprising:

a photographic processor adapted to process photographic material therein; and a photofinishing solution supply cartridge comprising an outer container and a single developer solution container provided within the outer container, said developer solution container holding a single-part developer therein and comprising two developer container valves for fluid communication with said photographic processor;

wherein said single developer solution container is reusable and comprises a supply opening to permit a refilling of said single developer solution container with single-part developer.

9. A photofinishing arrangement according to claim 8, further comprising:

a stabilizer solution container provided in said outer container and comprising a stabilizer solution container valve for fluid communication with the photographic processor, said outer container having at least three openings to permit said two developer container valves and said stabilizer solution container valve to pass there-through.

10. A photofinishing arrangement according to claim 8, wherein during a processing cycle, said developer solution container is adapted to supply said single-part developer to the photographic processor simultaneously through said two developer container valves.

* * * * *